US007866230B2

(12) United States Patent
Tanner et al.

(10) Patent No.: US 7,866,230 B2
(45) Date of Patent: Jan. 11, 2011

(54) APPARATUS FOR RELEASABLY SECURING A ROTATABLE OBJECT IN A PREDETERMINED POSITION

(75) Inventors: Justin A. Tanner, Queen Creek, AZ (US); Todd Langston, Chandler, AZ (US); David Tornquist, Chandler, AZ (US); Casey Hanlon, Queen Creek, AZ (US); James I. Kern, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 394 days.

(21) Appl. No.: 12/016,552

(22) Filed: Jan. 18, 2008

(65) Prior Publication Data

US 2009/0183596 A1 Jul. 23, 2009

(51) Int. Cl.
*G05G 5/06* (2006.01)
*H01F 7/20* (2006.01)

(52) U.S. Cl. ..... 74/527; 335/285; 335/296

(58) Field of Classification Search ..... 335/296, 335/285; 74/527, 813 R–813 L
See application file for complete search history.

(56) References Cited

U.S. PATENT DOCUMENTS

| | | | |
|---|---|---|---|
| 2,656,178 | A | 10/1953 | Hughes, Jr. |
| 3,356,357 | A | 12/1967 | Levine |
| 3,786,986 | A | 1/1974 | Guerrero |
| 3,934,216 | A | 1/1976 | Ward |
| 3,955,809 | A | 5/1976 | Hara et al. |
| 4,132,128 | A | 1/1979 | Roggenkamp |
| 4,693,027 | A | 9/1987 | Wolff, Sr. et al. |
| 4,899,073 | A | 2/1990 | Takeuchi et al. |
| 5,018,397 | A | 5/1991 | Matich |
| 5,623,854 | A | 4/1997 | Snider |
| 5,743,146 | A | 4/1998 | Oesterle et al. |
| 5,918,348 | A | 7/1999 | Carpenter et al. |
| 6,408,484 | B1 | 6/2002 | Vandertouw |
| 6,424,245 | B1 | 7/2002 | Rector et al. |
| 6,518,685 | B2 | 2/2003 | Nelson |
| 6,652,783 | B2 | 11/2003 | Fujita et al. |
| 2004/0026840 | A1 | 2/2004 | Eckel et al. |
| 2006/0023390 | A1 | 2/2006 | Spurr et al. |
| 2008/0272243 | A1 | 11/2008 | Decker |

FOREIGN PATENT DOCUMENTS

| | | | |
|---|---|---|---|
| DE | 4331655 | A1 | 4/1995 |
| EP | 0352417 | A2 | 1/1990 |
| EP | 1102290 | A2 | 5/2001 |
| EP | 1471551 | A2 | 10/2004 |
| GB | 1135458 | A | 12/1968 |
| WO | 2005096113 | A2 | 10/2005 |

OTHER PUBLICATIONS

EP Search Report dated Dec. 21, 2009, EP 09150575.0-1252/2081098.

*Primary Examiner*—Ramon M Barrera
(74) *Attorney, Agent, or Firm*—Ingrassia Fisher & Lorenz, P.C.

(57) ABSTRACT

An apparatus is provided for biasing a shaft toward, and releasably securing it in, a predetermined position. The apparatus comprises a magnetic assembly coupled to the shaft for releasably securing the shaft in a predetermined position, a first member coupled to and extending from the shaft for rotating the shaft from the predetermined position, and a spring assembly coupled to the shaft for securing the shaft in the predetermined position.

15 Claims, 8 Drawing Sheets

APPARATUS FOR RELEASABLY SECURING A ROTATABLE OBJECT IN A PREDETERMINED POSITION

FIELD OF THE INVENTION

The present invention generally relates to an apparatus for manipulating a rotatable object, and more particularly relates to an apparatus for biasing a rotatable object toward, and releasably securing it in, a predetermined position.

BACKGROUND OF THE INVENTION

On some devices there is a need to bias a rotatable object toward a predetermined position on its rotational axis. For example, some aircraft flight control systems utilize a gimbal assembly to translate any movements of a flight control stick into the rotation of a plurality of shafts about two rotational axes. These shafts may be biased to a predetermined position to enable the flight control stick to return to a null position when it is released by the pilot or co-pilot. Such a mechanism provides the pilot or co-pilot with a simple method for stabilizing the flight of the aircraft.

In addition, in some devices, it may be desirable to releasably secure a rotatable object in a predetermined position on its rotational axis. In this secured state, a force is required to release the object from the predetermined position, providing physical feedback to the user of the object and indicating to the user that the mechanism is in the predetermined position. For example, a control stick that is coupled to a gimbal assembly may be releasably secured in its null position by securing each of the shafts in a predetermined position about its axis of rotation, preventing the control stick from moving unless the pilot or co-pilot applies enough force to release one or both of the shafts.

Accordingly, it is desirable to have both an apparatus for biasing a rotatable object toward a predetermined position on its rotational axis. It would further be desirable to provide an apparatus that can releasably secure a rotatable object in a predetermined position. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

An apparatus is provided for biasing a shaft toward, and releasably securing it in, a predetermined position on its rotational axis. The apparatus comprises a magnetic assembly coupled to the shaft for releasably securing the shaft in the predetermined position, a first member coupled to the shaft for rotating the shaft from the predetermined position, and a spring assembly coupled to the shaft for returning the shaft to the predetermined position.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention. Although the diagrams shown herein depict example arrangements of elements, additional intervening elements, devices, features, or components may be present in an actual embodiment. It should also be understood that FIGS. 1-9 are merely illustrative and may not be drawn to scale.

Figure 1:
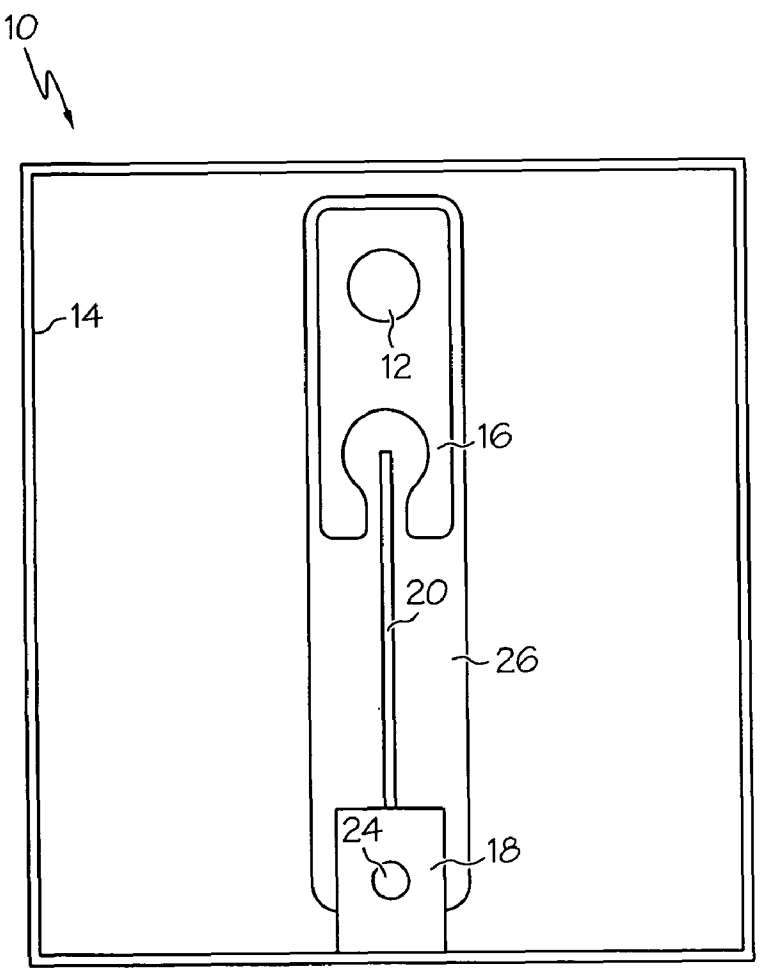
FIG. 1 is a side plan view of a first embodiment of the present invention.

FIG. 1 is a side plan view of an exemplary apparatus 10 for biasing a rotatable object toward, and releasably securing it in, a predetermined position. As depicted, the apparatus 10 includes a shaft 12 that is configured to rotate (as indicated by arrow 13) from the predetermined position, which is the position depicted in FIG. 1, to a plurality of control positions. At least one end of the shaft 12 is rotatably coupled to a housing 14. The rotatable object (not shown) is fixably coupled to the shaft and configured to receive an input force that moves the shaft 12 away from the predetermined position. It may comprise a knob, dial, control device, or any other object that is capable of being manipulated to rotate the shaft 12.

In addition, the apparatus 10 includes a spring assembly, configured to bias the shaft 12 toward the predetermined position. The spring assembly includes a rotatable first spring receptacle 16 that is fixably coupled to the shaft 12, a second spring receptacle 18 that is fixably coupled to the housing 14, and a spring member 20. The spring member 20 provides the force that biases the shaft 12 toward the predetermined position. In the illustrated embodiment, the spring member 20 comprises a beam spring. One end of the spring member 20 is slidably received by the first spring receptacle 16, and the other end is fixably restrained by the second spring receptacle 18. As depicted in FIG. 1, when the shaft 12 is in the predetermined position, the spring member 20 is in its rest state (e.g., straight) such that it does not exert any rotational force on the shaft 12. It will be understood by one skilled in the art that although the illustrated embodiment depicts the use of a single beam spring, other embodiments, including those described below, may use alternative numbers and types of springs.

Figure 2:
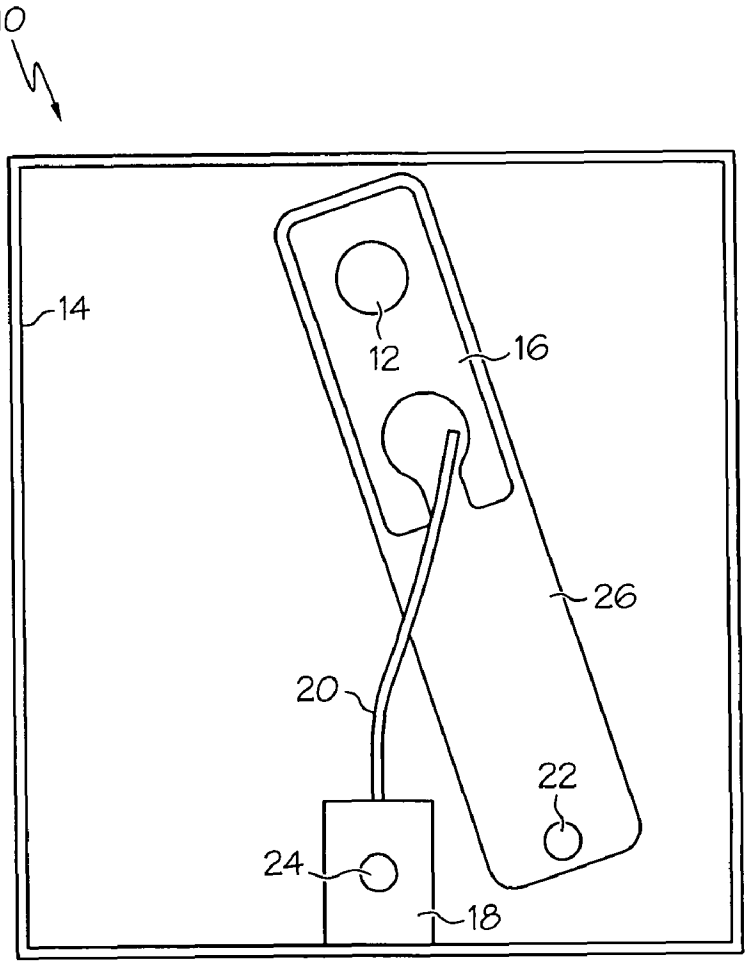
FIG. 2 is a side plan view of the first embodiment of the present invention, depicting a rotated shaft.

FIG. 2 is a side plan view of the apparatus 10 of FIG. 1 depicting the shaft 12 in a rotated position. As depicted, when the shaft 12 is rotated the first spring receptacle 16 rotates with the shaft 12 and the second spring receptacle 18 remains stationary, causing the spring member 20 to flex away from its rest state. When the shaft 12 is released (e.g., the input force that caused the shaft 12 to rotate is removed), the spring member 20 straightens, exerting a rotational force on the shaft 12, via the first spring receptacle 16, and returning the shaft 12 to the predetermined position. This configuration ensures that the shaft 12 returns to the predetermined position when it is rotated.

In addition, the illustrated apparatus 10 also includes a magnetic assembly that comprises first and second magnets 22, 24 for releasably securing the shaft 12 in the predetermined position. The first magnet 22 is positioned proximate an outer end of a rotatable arm 26 that is coupled to and extends outwardly from the shaft 12. The second magnet 24 is coupled to an object that does not rotate about the shaft 12, such as the second spring receptacle 18 as depicted. As shown in FIG. 2, when the shaft 12 is rotated away from the predetermined position, the first and second magnets 22, 24 are separated so that there is no magnetic engagement between them and they have no influence on the rotation of the shaft 12.

Returning to FIG. 1, the first magnet 22 (FIG. 2) is in close proximity with, and magnetically coupled to, the second magnet 24 when the shaft 12 is in the predetermined position. This configuration releasably secures the shaft 12 in the predetermined position so that it will not rotate unless a force is applied to the rotatable object that is strong enough to overcome the magnetic attraction between the first and second magnets 22, 24.

It will be understood by one who is skilled in the art that the magnetic assembly may also comprise a single magnet and an object that is constructed from a magnetically permeable material, such as steel or some other ferrous material. For example, in one alternative embodiment the magnetic assembly may comprise the first magnet 22 positioned proximate an outer end of the rotatable arm 26 and a second spring assembly 18 that is magnetically permeable. In this embodiment, the first magnet 22 is in close proximity with, and magnetically coupled to, the magnetically permeable second spring assembly 18 when the shaft 12 is in the predetermined position. In another embodiment, the magnetic assembly may comprise the second magnet 24 and a rotatable arm 26 that is magnetically permeable. In this embodiment, the second magnet 24 is in close proximity with, and magnetically coupled to, the magnetically permeable rotatable arm 26 when the shaft 12 is in the predetermined position.

In addition, in the illustrated embodiment, the first and second magnets 22, 24 are depicted as permanent magnets. However, it will be understood by one skilled in the art that alternative embodiments may include different numbers and types of magnets. For example, some embodiments of the magnetic assembly may include one or more electromagnets. The use of electromagnets has the added benefit of allowing the shaft 12 to be released from the predetermined position by deactivating the electromagnets.

Figure 3:
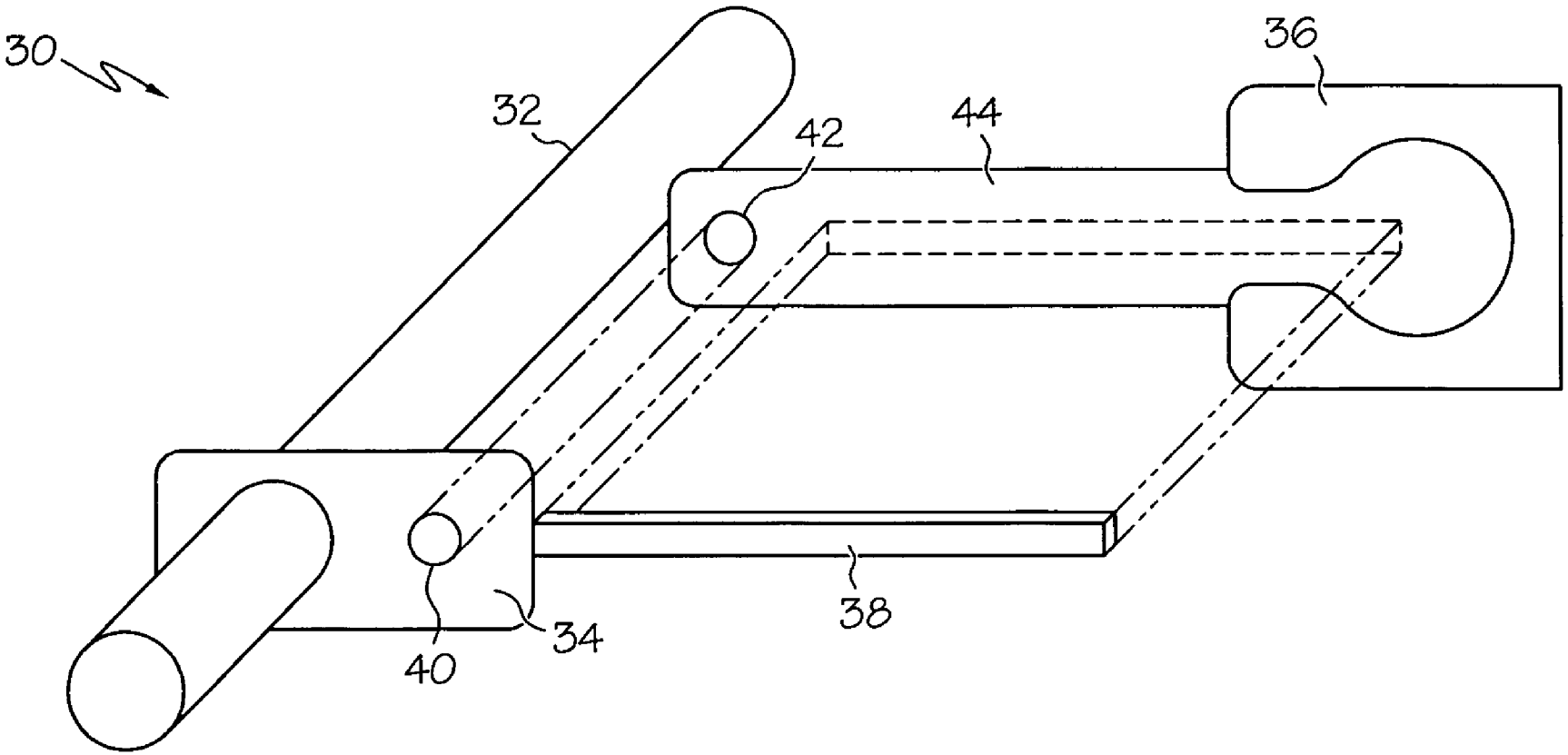
FIG. 3 is an exploded view of a second embodiment of the present invention.

FIG. 3 is an exploded view of a second embodiment of the apparatus 30, including a shaft 32, a spring assembly comprising a first spring receptacle 34, a second spring receptacle 36, and a spring member 38, and a magnetic assembly comprising first and second magnets 40, 42. The first spring receptacle 34 is coupled to the shaft 32 for rotation therewith and the second spring receptacle 36 is coupled to a non-illustrated housing. The spring member 38 comprises a beam spring that is fixably retained by the first spring receptacle 34 on one end and slidably received by the second spring receptacle 36 on the other end. Thus, when the shaft 32 is rotated away from the predetermined position, the first spring receptacle 34 and the spring member 38 rotate as well. The second spring receptacle 36, however, remains stationary causing the spring member 38 to flex away from its rest state (e.g., straight). When the shaft 32 is released, the spring member 38 straightens, exerting a rotational force on the shaft 32, via the first spring receptacle 34, and returning the shaft 32 to the predetermined position.

The magnetic assembly of the embodiment of FIG. 3 comprises first and second magnets 40, 42. The first magnet 40 is coupled to the shaft 32. For example, in the illustrated embodiment the first magnet 40 is coupled to the first spring receptacle 34. The second magnet 42 is positioned on the outer end of a rotatable arm 44 that is coupled to and extends outwardly from the non-illustrated housing. When the shaft 32 is in the predetermined position, the first and second magnets 40, 42 are in close proximity with, and magnetically coupled to, one another, releasably securing the shaft 32 in the predetermined position.

FIGS. 4-7 depict additional embodiments of the invention that utilize alternative spring assemblies. Each of these embodiments includes a shaft and a magnetic assembly that function in the manner previously described with regard to FIGS. 1 and 2, and therefore, only the alternative spring assemblies will be described.

Figure 4:
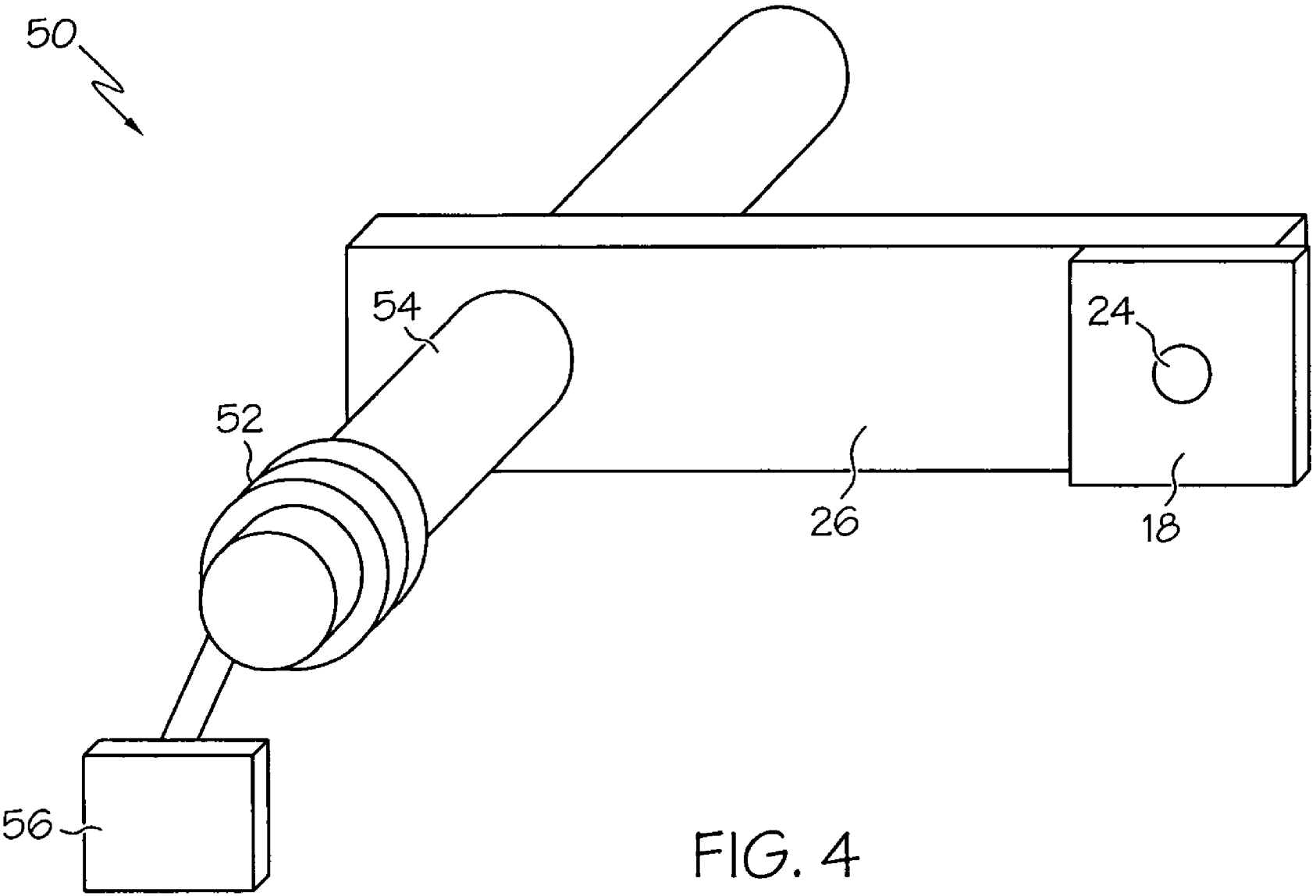
FIG. 4 is a isometric view of a third embodiment of the present invention.

FIG. 4 is an isometric view of a third embodiment of the apparatus 50. In this embodiment, the spring member 52 comprises a helical torsion spring that is coupled to the shaft 54 on one end and to an object 56 that does not rotate about the shaft 54 (e.g., the housing of the apparatus 50) on the other end. As depicted, the shaft 54 is in a predetermined position, and the spring 52 is in its rest stated and does not exert any rotational force on the shaft 54. Rotating the shaft 54 in any direction causes the end of the spring 52 that is coupled to the shaft 54 to rotate while the other end remains stationary, resulting in the spring 52 being coiled or uncoiled away from its rest state. When the shaft 54 is released, the spring 52 returns to its rest state, exerting a rotational force on the shaft 54 and returning it to the predetermined position.

Figure 5:
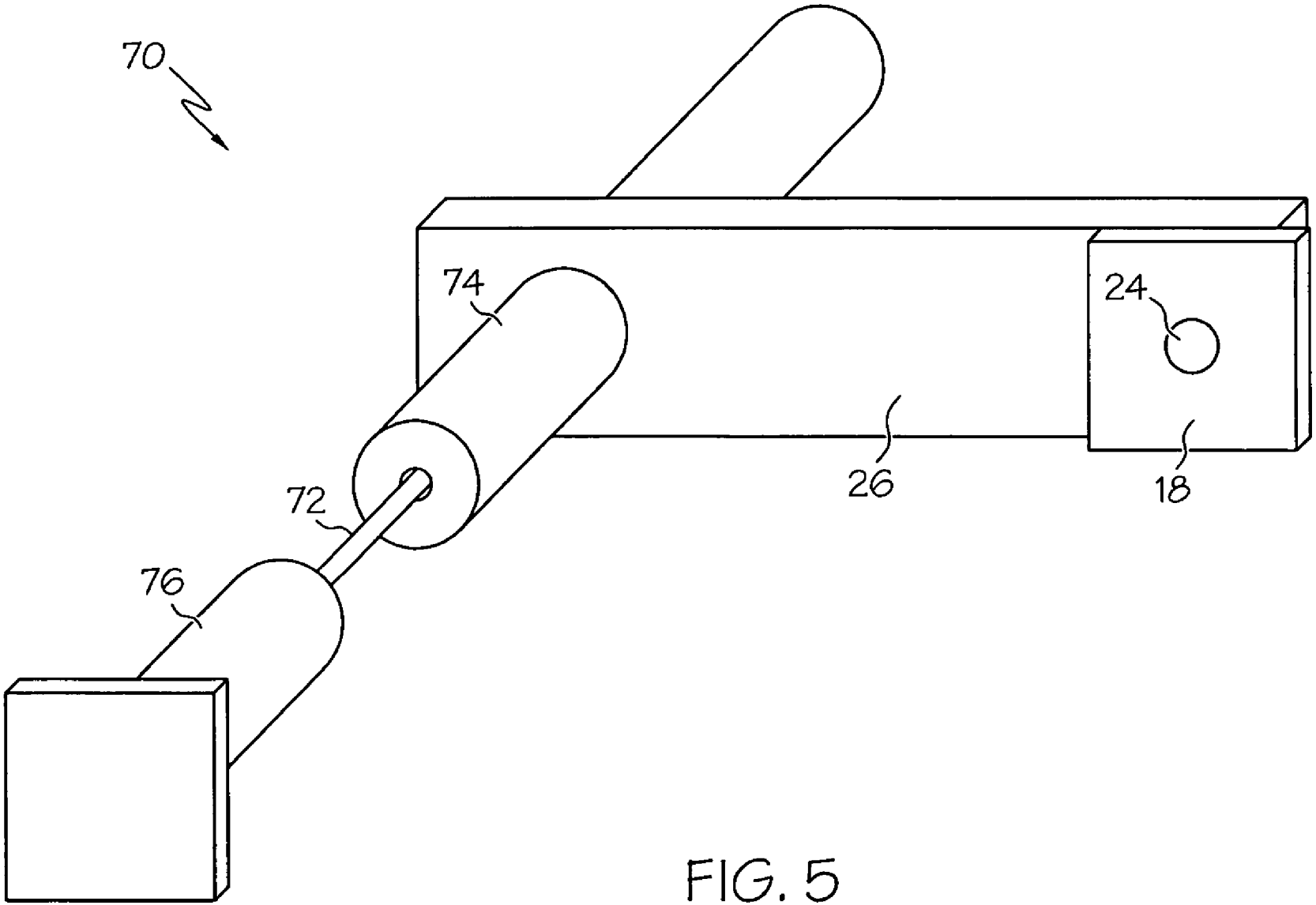
FIG. 5 is a isometric view of a fourth embodiment of the present invention.

FIG. 5 is an isometric view of a fourth embodiment of the apparatus 70. In this embodiment, the spring member comprises at least one torsion bar spring 72 that is coupled to the shaft 74 on one end and to an object 76 that does not rotate about the shaft 74 on the other end. As depicted, the shaft 74 is in a predetermined position and the bar torsion spring 72 is in its rest state (e.g., untwisted). Rotating the shaft 74 away from the predetermined position causes the bar torsion spring 72 to twist away from its rest state. When the shaft 74 is released, the bar torsion spring 72 untwists and returns to its rest state, exerting a rotational force on the shaft 74 and returning it to the predetermined position.

Figure 6:
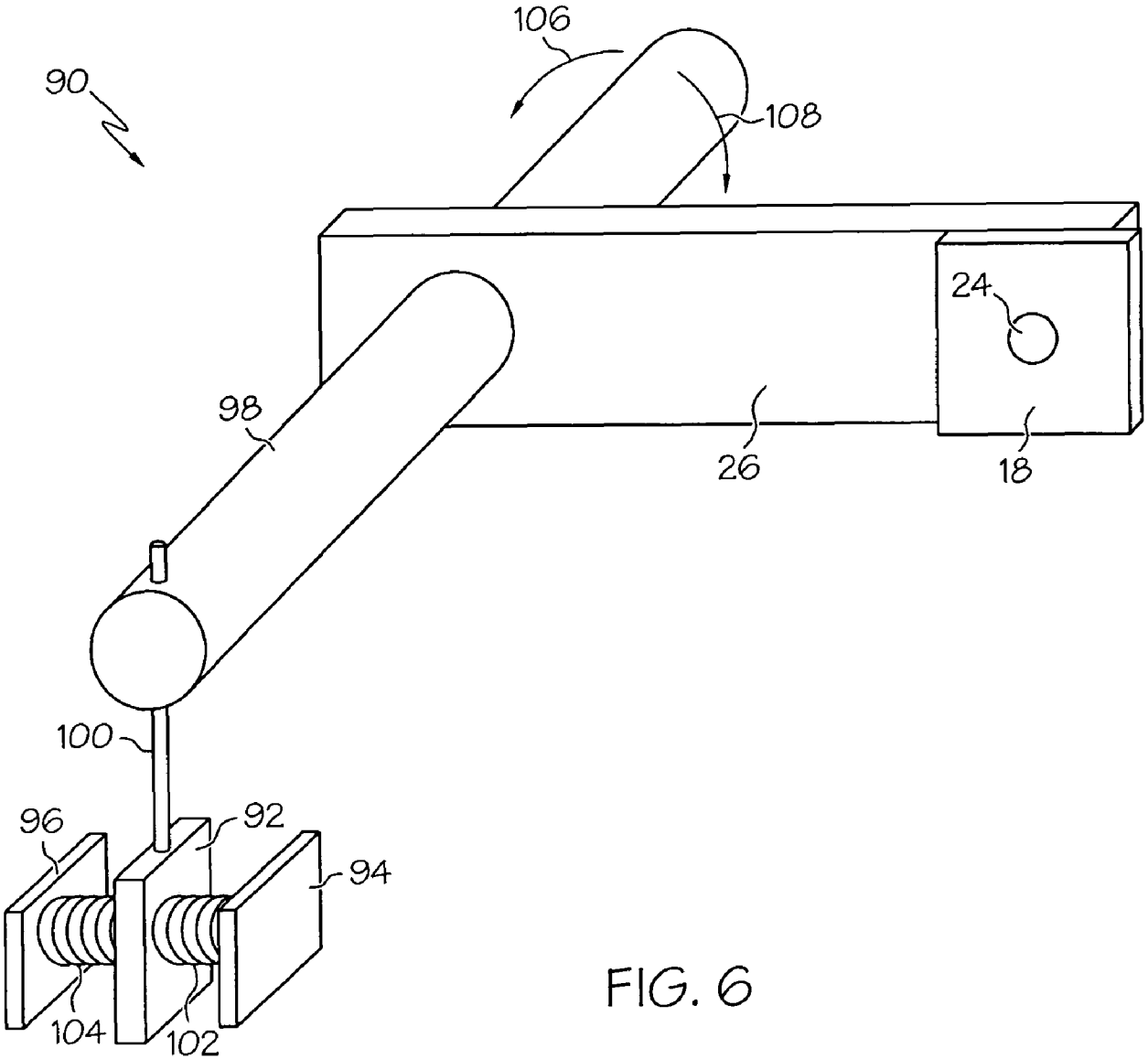
FIG. 6 is a isometric view of a fifth embodiment of the present invention.

FIG. 6 is an isometric view of a fifth embodiment of the apparatus 90. In this embodiment the spring assembly includes a paddle 92 that sits between two oppositely disposed surfaces 94, 96. The paddle 92 is coupled to the shaft 98 via an outwardly extending rod 100 and the surfaces 94, 96 are coupled to an object that does not rotate about the shaft 98 (e.g., the housing of the apparatus 90). A first spring 102 is coupled to surface 94 and to a first side of the paddle 92 and a second spring 104 is coupled to surface 96 and to a second side of the paddle 92. The first and second springs 102, 104 comprise compression springs that resist any compressive or tensile force that moves them away from their rest state.

As depicted in FIG. 6, the shaft 98 is in a predetermined position and the first and second springs 102, 104 are in their rest state with the paddle 92 is centered between the surfaces 94, 96. Rotating the shaft 98 in a first direction 106, rotates the paddle 92 closer to surface 94 and compresses the first spring 102 away from its rest state. Likewise, rotating the shaft in the other direction 108, rotates the paddle 92 closer to surface 96 and compresses the second spring 104 away from its rest state. In either case, when the shaft 98 is released, the first and second springs 102, 104 return to their rest states, exerting a rotational force on the shaft 98, via the paddle 92, and returning the shaft 98 to the predetermined position.

Figure 7:
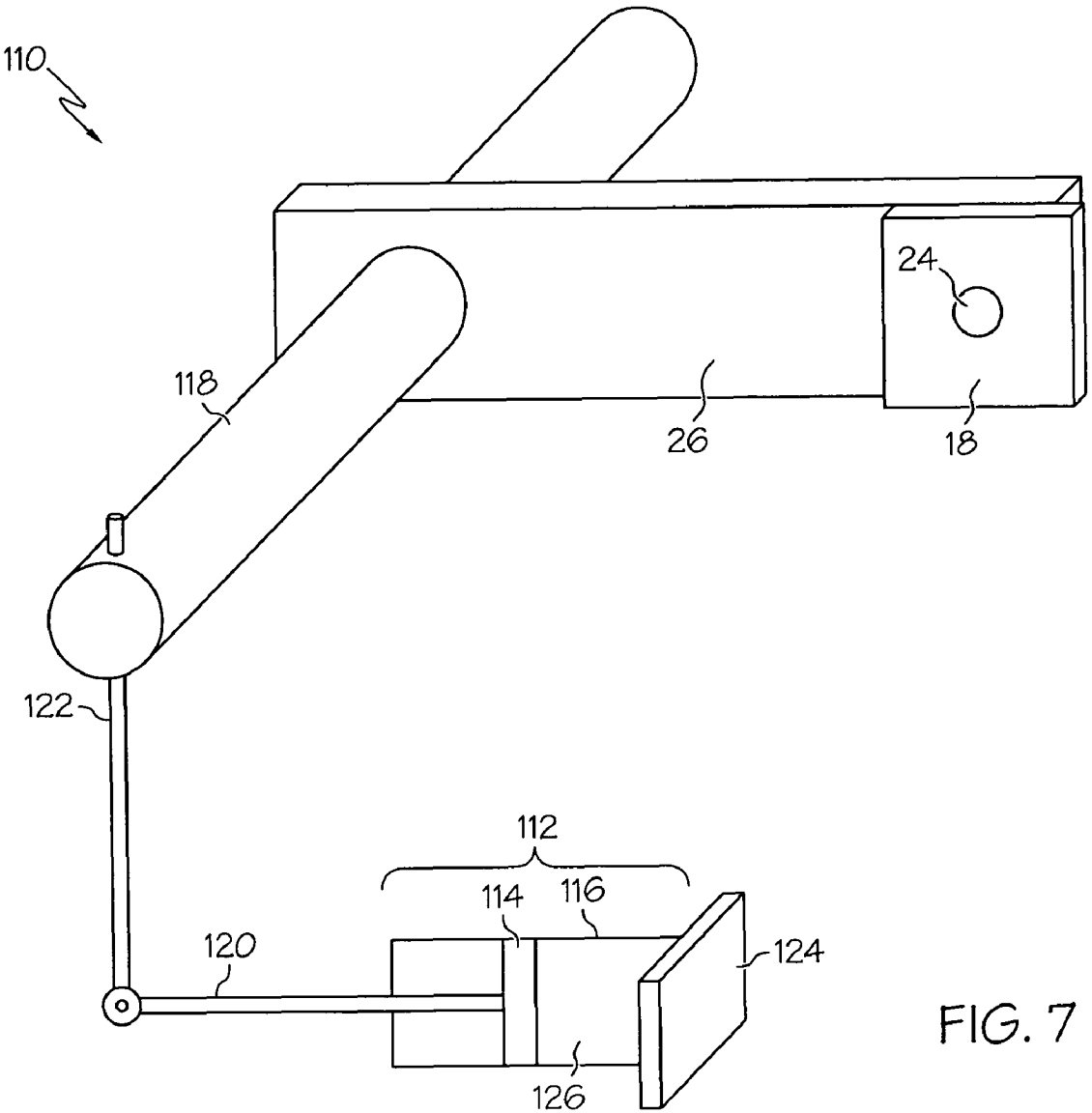
FIG. 7 is a isometric view of a sixth embodiment of the present invention.

FIG. 7 is an isometric view of a sixth embodiment of the apparatus 110. In this embodiment, the spring member comprises a pneumatic return spring 112 that includes a piston 114 that is slidably disposed inside of a cylinder 116. The piston 114 is coupled to the shaft 118 via a piston rod 120 and shaft rod 122. The shaft rod 122 extends outwardly from the shaft 118 and is hingeably coupled to the piston rod 120 at its far end. The other end of the piston rod 120 is coupled to the piston 114 on the other end so that any rotation of the shaft 118 causes the piston 114 to slide within the cylinder 116. The cylinder 116 is fixably coupled to an object 124 (e.g., the housing of the apparatus 110) that does not rotate about the shaft 118.

The piston 114 and the cylinder 116 define an inner chamber 126 that sealably encloses a fluid. The pressure of the fluid within the inner chamber 126 exerts an outward force on the piston 114. When the shaft 118 is in a predetermined position, the pneumatic return spring 112 is in its rest state as outward pressure that the fluid exerts on the piston 114 is equal to the inward pressure exerted on the piston 114. Rotating the shaft 118 in either direction, slides the piston 114 within the cylinder 116, changing the volume of the inner chamber 126. This changes the outward pressure that is exerted on the piston 114 by the fluid, removing the pneumatic return spring 112 from its rest state. When the shaft 118 is released, the piston 114 slides to its original position, exerting a rotational force on the shaft 118, via the piston rod 120 and shaft rod 122, and returning the shaft 118 to the predetermined position.

Figure 8:
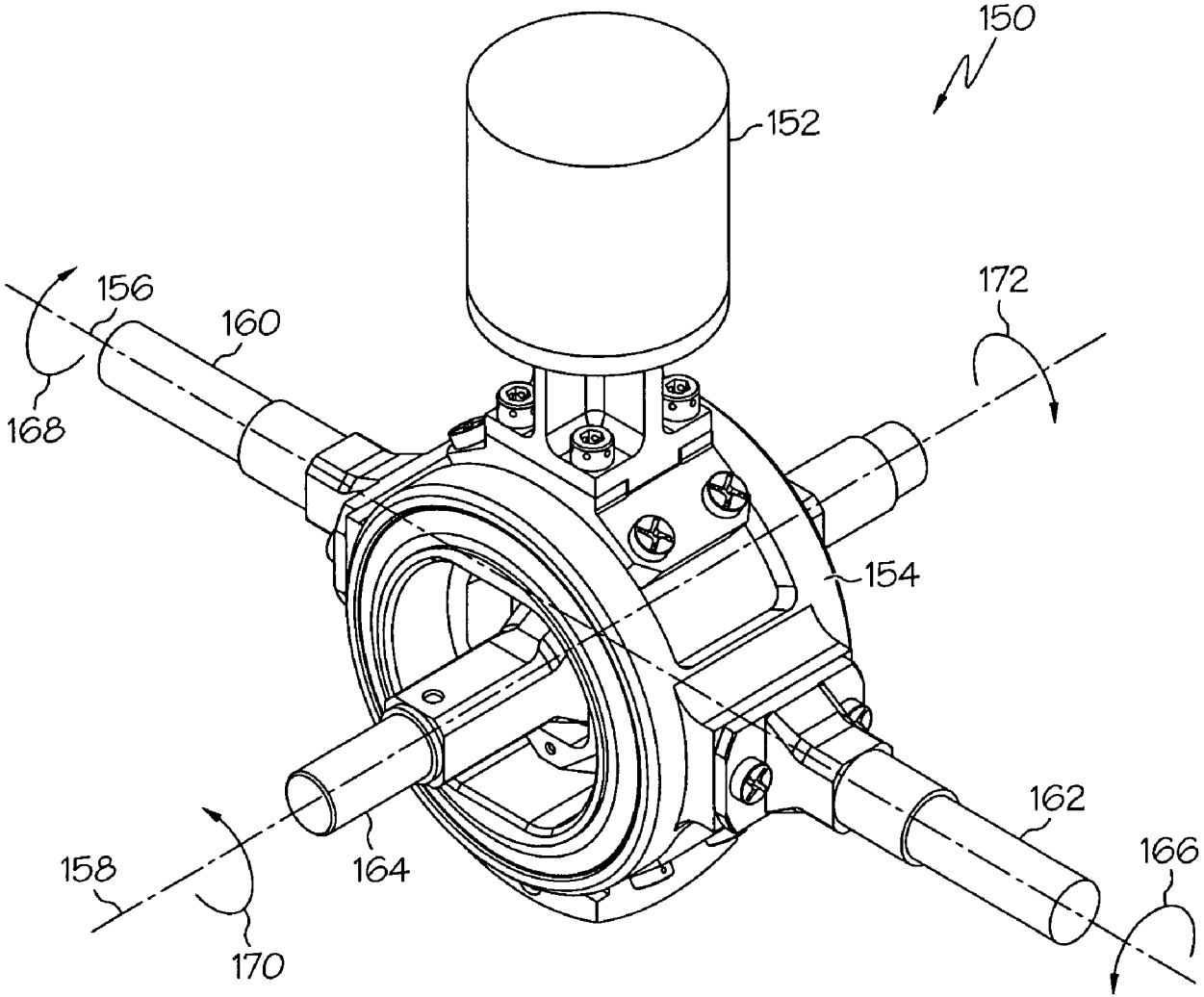
FIG. 8 is a isometric view of an exemplary human-machine interface assembly.

Embodiments of the present invention may be utilized in conjunction with devices that have multiple shafts, to bias the shafts toward, and releasably retain them in, a predetermined position. For example, FIG. 8 depicts an exemplary embodiment of a human-machine interface assembly 150 suitable for use with the present invention. The human-machine interface assembly 150 includes a user interface 152 and a gimbal assembly 154. The user interface 152 is coupled to the gimbal assembly 154 and is configured to receive an input force from a user. The user interface 152 may be implemented as a grip or control stick that is preferably dimensioned to be grasped by the hand of a user, such as the pilot or co-pilot of an aircraft.

The gimbal assembly 154 is preferably mounted within a suitable, non-illustrated housing assembly, and is configured to allow the user interface 152 to be moved from a null position, which is the position depicted in FIG. 8, to a plurality of control positions in a plurality of directions. More specifically, the gimbal assembly 154, in response to an input force supplied to the user interface 152, allows the user interface 152 to be moved from the null position to a plurality of control positions, about two perpendicular rotational axes (e.g., a first rotational axis 156 and a second rotational axis 158 as shown). It will be appreciated that the human-machine interface assembly 150 may be implemented as an aircraft flight control system, with the user interface 152 functioning as a flight control stick. In such an embodiment, the first and second rotational axes 156, 158 may be referred to as the roll and pitch axes, respectively.

The gimbal assembly 154 includes a first roll shaft 160, second roll shaft 162 and a pitch shaft 164. The first and second roll shafts 160, 162 are each fixably coupled to opposing ends of the gimbal assembly 154, for rotation therewith about the first rotational axis 156. The pitch shaft 164 is coupled to the gimbal assembly 154 for rotation therewith about the second rotational axis 158.

The gimbal assembly 154 is configured to permit the user interface 152 to be movable about the first and second rotational axes 156, 158 and to translate any movement of the user interface 152 into a corresponding rotation of the first and second roll shafts 160, 162 and/or the pitch shaft 164. For example, movement of the user interface 152 about the first rotational axis 156 in the port direction 166 and starboard direction 168 result in a rotation of the gimbal assembly 154 and the first and second roll shafts 160, 162 about the first rotational axis 156. Further, movement of the user interface 152 about the second rotational axis 158 in a forward direction 170 or an aft direction 172, result in the rotation of the gimbal assembly 154 and the pitch shaft 164 about the second rotational axis 158. It will be appreciated that the gimbal assembly 154 is configured to allow the user interface 152 to be moved in a combined forward-port direction, a combined forward-starboard direction, a combined aft-port direction, or a combined aft-starboard direction, and back to or through the null position, resulting in the rotation of the first and second roll shafts 160, 162 about the first rotational axis 156, and the pitch shaft 164 about the second rotational axis 158. It will additionally be appreciated that the gimbal assembly 154 may be configured using any one of numerous gimbal assembly implementations now known.

Figure 9:
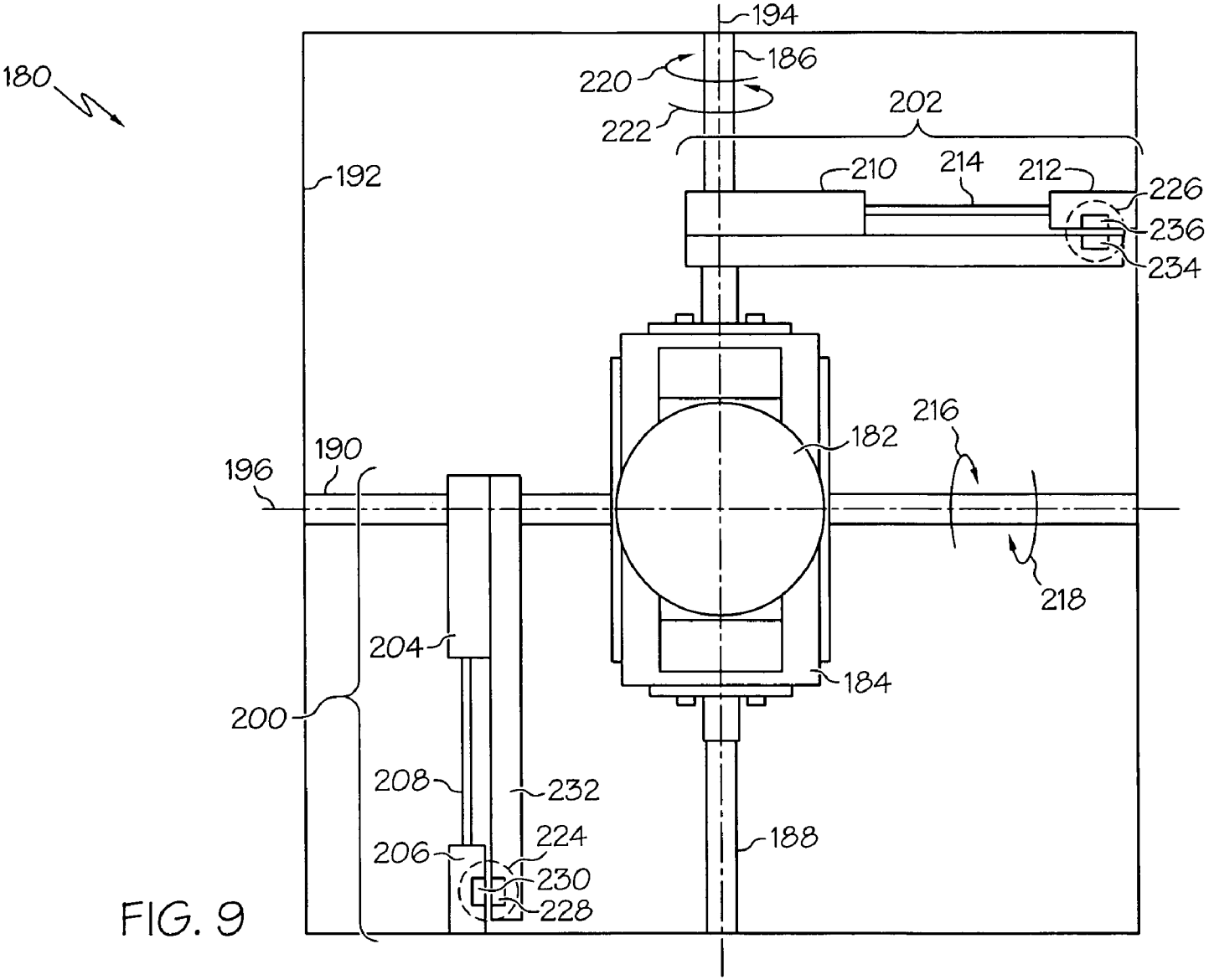
FIG. 9 is a top view of the human-machine interface assembly of FIG. 8 configured for use with embodiments of the present invention.

FIG. 9 depicts a human-machine interface assembly 180 of FIG. 8 configured for use with embodiments of the present invention. The human-machine interface assembly 180 includes the user interface 182, gimbal assembly 184, first roll shaft 186, second roll shaft 188, pitch shaft 190, and housing 192. The first and second roll shafts 186, 188 are rotatably coupled to the housing 192 along the first rotational axis 194 and the pitch shaft 190 is rotatably coupled to the housing 192 along the second rotational axis 196.

The human-machine interface assembly 180 includes a spring assembly and a magnetic assembly for biasing the user interface 182 toward, and releasably securing it in, the predetermined position. The spring assembly comprises a pitch shaft spring assembly 200 and a roll shaft spring assembly 202. In the illustrated embodiment the pitch shaft spring assembly 200 and roll shaft spring assembly 202 are of the type described above with regard to FIGS. 1-2, however, it should be understood that any suitable spring assembly may be used, including those described above with regard to FIGS. 3-7.

The pitch shaft spring assembly 200 includes a first spring receptacle 204 that is coupled to the pitch shaft 190, a second spring receptacle 206 that is coupled to the housing 192, and a spring member 208 (e.g., a beam spring as shown). The spring member 208 is slidably received by the first spring receptacle 204 on one end and fixably restrained by the second spring receptacle 206 on the opposite end. The roll shaft spring assembly 202, including two spring receptacles 210, 212 and a spring member 214, is coupled to the first roll shaft 186 and to the housing 192 in the same manner. It should also be understood that in alternative embodiments the pitch shaft spring assembly 200 and the roll shaft spring assembly 202 may be arranged differently within the human-machine interface assembly 180. For example, in a separate embodiment, the roll shaft spring assembly 202 may be coupled to the second roll shaft 188 and to the housing 192.

As depicted in FIG. 9, the user interface 182 is in the null position with respect to the second rotational axis 196, the pitch shaft 190 is in the predetermined position on the second rotational axis 196, and the spring member 208 is in its rest state (e.g., straight). As described above, any movement of the user interface 182 in the forward direction 216 or aft direction 218 results in the rotation of the pitch shaft 190 away from its predetermined position, flexing the spring member 208 away from its rest state. When the user releases the user interface 182, the spring member 208 straightens, exerting a rotational force on the pitch shaft 190, via the first spring receptacle 204, and returning the user interface 182 to the null position with respect to the second rotational axis 196.

In the same manner, movement of the user interface 182 in the port direction 220 or starboard direction 222 rotates the first roll shaft 186 away from the predetermined position, flexing the spring member 214 away from its rest state. When the user releases the user interface 182, the spring member 214 straightens, exerting a rotational force on the first roll shaft 186 and returning the user interface 182 to the null position with respect to the first rotational axis 194. Thus, together the pitch shaft spring assembly 200 and the roll shaft spring assembly 202 work together to bias the user interface 182 toward the null position, The magnetic assembly comprises a pitch shaft magnetic assembly 224 and a roll shaft magnetic assembly 226. The pitch shaft magnetic assembly 224 includes first and second magnets 228, 230. As illustrated, the first magnet 228 is coupled to the outer end of a rotatable arm 232 that is coupled to and extends outwardly from the pitch shaft 190. The second magnet 230 is coupled to the second spring receptacle 206 and positioned to be magnetically coupled to the first magnet 228 when the pitch shaft 190 is in the predetermined position. The roll shaft magnetic assembly 226, including two magnets 234, 236, is coupled to the first roll shaft 186 in the same manner. The illustrated embodiment depicts the use of permanent magnets, however, as described above, in alternate embodiments other types of magnets or magnetically permeable objects may be used to releasably secure the shaft, including objects constructed of steel, or some other ferrous material, or electromagnets. In addition, in alternative embodiments each magnetic member may include additional magnets or magnet configurations.

When an input force that is strong enough to overcome the magnetic engagement of the first and second magnets 228, 230 is applied to the user interface 182 to move it in the port direction 220 or a starboard direction 222, the pitch shaft 190 is rotated away from its predetermined position and the first and second magnets 228, 230 are separated. In this position, the first and second magnets 228, 230 do not have any influence on the rotation of the pitch shaft 190. Similarly, when enough force is applied to the user interface 182 to move it in the forward direction 216 or aft direction 218, the roll shaft magnetic assembly 226 has no influence on the rotation of the first roll shaft 186.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. An apparatus for releasably securing a shaft in a predetermined position, comprising:

a magnetic assembly, coupled to the shaft, for releasably securing the shaft in the predetermined position;

a first member, coupled to the shaft, for rotating the shaft from the predetermined position; and a spring assembly, coupled to the shaft, for returning the shaft to the predetermined position, the spring assembly comprising:

a non-rotating member fixably positioned so that it does not rotate about the shaft, and a beam spring member coupled to the shaft and to the non-rotating member and configured to bias the shaft toward the predetermined position.

2. The apparatus of claim 1, wherein the magnetic assembly comprises:

a first magnetic member coupled to the shaft for rotation therewith; and a second magnetic member positioned to be magnetically coupled to the first magnetic member when the shaft is in the predetermined position.

3. The apparatus of claim 2, wherein at least one of the first magnetic member and the second magnetic member comprises at least one permanent magnet.

4. The apparatus of claim 2, wherein at least one of the first magnetic member and the second magnetic member comprises at least one electromagnet.

5. An apparatus for releasably securing an object in a predetermined position, the object configured to move from the predetermined position to a plurality of control positions about a first rotational axis and a second rotational axis, the apparatus comprising:

a first shaft coupled to the object for rotation therewith about the first rotational axis;

a second shaft coupled to the object for rotation therewith about the second rotational axis;

a magnetic assembly coupled to the first shaft and to the second shaft for releasably securing the object in the predetermined position; and a spring assembly coupled to the first shaft and to the second shaft for biasing the object toward the predetermined position.

6. The apparatus of claim 5, wherein the object is a flight control stick.

7. The apparatus of claim 5, wherein the magnetic assembly comprises:

a first magnetic assembly coupled to the first shaft, comprising:

a first magnetic member coupled to the first shaft for rotation therewith; and a second magnetic member positioned to be magnetically coupled to the first magnetic member when the first shaft is in the predetermined position with respect to the first rotational axis; and a second magnetic assembly coupled to the second shaft, comprising:

a third magnetic member coupled to the second shaft for rotation therewith; and a fourth magnetic member positioned to be magnetically coupled to the third magnetic member when the second shaft is in the predetermined position with respect to the second rotational axis.

8. The apparatus of claim 7, wherein at least one of the first magnetic member, the second magnetic member, the third magnetic member, and the fourth magnetic member comprises at least one permanent magnet.

9. The apparatus of claim 7, wherein at least one of the first magnetic member, the second magnetic member, the third magnetic member, and the fourth magnetic member comprises at least one electromagnet.

10. The apparatus of claim 5, wherein the spring assembly comprises:

a first spring assembly coupled to the first shaft, comprising:

a first non-rotating member fixably positioned so that it does not rotate about the first shaft; and a first spring member coupled to the first shaft and to the first non-rotating member and configured to bias the first shaft toward the predetermined position on the first rotational axis; and a second spring assembly coupled to the second shaft, comprising:

a second non-rotating member fixably positioned so that it does not rotate about the second shaft; and a second spring member coupled to the second shaft and to the second non-rotating member and configured to bias the second shaft toward the predetermined position on the second rotational axis.

11. The apparatus of claim 10, wherein at least one of the first spring member and the second spring member comprises at least one beam spring.

12. The apparatus of claim 10, wherein at least one of the first spring member and the second spring member comprises at least one torsion spring.

13. The apparatus of claim 10, wherein at least one of the first spring member and the second spring member comprises at least one compression spring.

14. The apparatus of claim 10, wherein at least one of the first spring member and the second spring member comprises at least one pneumatic return spring.

15. An apparatus for releasably securing an object in a predetermined position, the object configured to move from the predetermined position to a plurality of control positions about a first rotational axis and a second rotational axis, the apparatus comprising:

a first shaft assembly coupled to the object, comprising:

a first shaft coupled to the object for rotation therewith about the first rotational axis;

a first magnetic assembly coupled to the first shaft and configured to releasably secure the first shaft in the predetermined position about the first rotational axis; and a first spring assembly coupled to the first shaft and configured to bias the first shaft toward the predetermined position about the first rotational axis; and a second shaft assembly coupled to the object, comprising:

a second shaft coupled to the object for rotation therewith about the second rotational axis;

a second magnetic assembly coupled to the second shaft and configured to releasably secure the second shaft in the predetermined position about the second rotational axis; and a second spring assembly, coupled to the second shaft and configured to bias the second shaft toward the predetermined position about the second rotational axis.

* * * * *